US006646194B2

(12) United States Patent
Kikumoto

(10) Patent No.: US 6,646,194 B2
(45) Date of Patent: Nov. 11, 2003

(54) METHOD AND APPARATUS FOR WAVEFORM REPRODUCTION

(75) Inventor: Tadao Kikumoto, Inasa-gun (JP)

(73) Assignee: Roland Corporation, Los Angeles, CA (US)

( * ) Notice: Subject to any disclaimer, the term of this patent is extended or adjusted under 35 U.S.C. 154(b) by 0 days.

(21) Appl. No.: 09/894,324

(22) Filed: Jun. 28, 2001

(65) Prior Publication Data

US 2002/0046639 A1 Apr. 25, 2002

(30) Foreign Application Priority Data

Jun. 29, 2000 (JP) ..... 2000-196466

(51) Int. Cl.[7] ..... G10H 7/00
(52) U.S. Cl. ..... 84/600; 84/604
(58) Field of Search ..... 84/600, 622, 626, 84/645, 658, 659, 662, 734, 670, 735, 603, 604

(56) References Cited

U.S. PATENT DOCUMENTS

| | | | | |
|---|---|---|---|---|
| 5,247,131 A | * | 9/1993 | Okamoto et al. | 84/471 R |
| 5,265,516 A | * | 11/1993 | Usa et al. | 84/600 |
| 5,288,938 A | * | 2/1994 | Wheaton | 84/600 |
| 5,448,008 A | * | 9/1995 | Okamoto et al. | 84/471 R |
| 5,563,360 A | * | 10/1996 | Miyamoto et al. | 84/609 |
| 6,323,797 B1 | * | 11/2001 | Kikumoto et al. | 341/144 |
| 6,365,818 B1 | * | 4/2002 | Suzuki | 84/604 |

FOREIGN PATENT DOCUMENTS

| | | |
|---|---|---|
| JP | 03-184095 | 8/1991 |
| JP | 5-73054 | 3/1993 |
| JP | 11-52954 | 2/1999 |
| JP | 2001-188543 | 7/2001 |

* cited by examiner

*Primary Examiner*—Jeffrey Donels
(74) *Attorney, Agent, or Firm*—Foley & Lardner

(57) ABSTRACT

A waveform reproduction apparatus providing an intuitive way to operate controllers corresponding to musical time quantities such as beats and bars. The apparatus includes a first storage means for storing a series of waveform data; an input means for inputting location information corresponding to movement on a surface; a second storage means for storing position information corresponding to delimiters between segments of the waveform data stored in the first storage means, the waveform data having been divided into a multiple number of segments, and for storing corresponding position information indicating a position along the surface indicated by the surface movement data; a position information generation means, wherein the position information for the waveform data stored in the first storage means is generated from the corresponding position information stored in the second storage means in accordance with the positions that are indicated by the location information input by the input means; and waveform formation means for forming musical tones from waveform data stored in the first storage means in accordance with pitches that correspond to pitch information that has been specified and corresponding to the position information generated by the position information generation means.

9 Claims, 6 Drawing Sheets

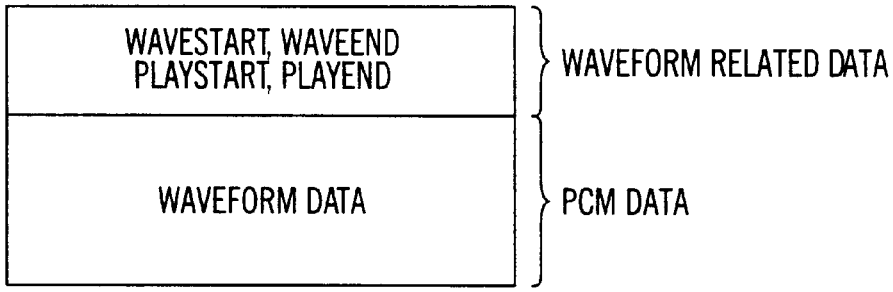
FIG. 3
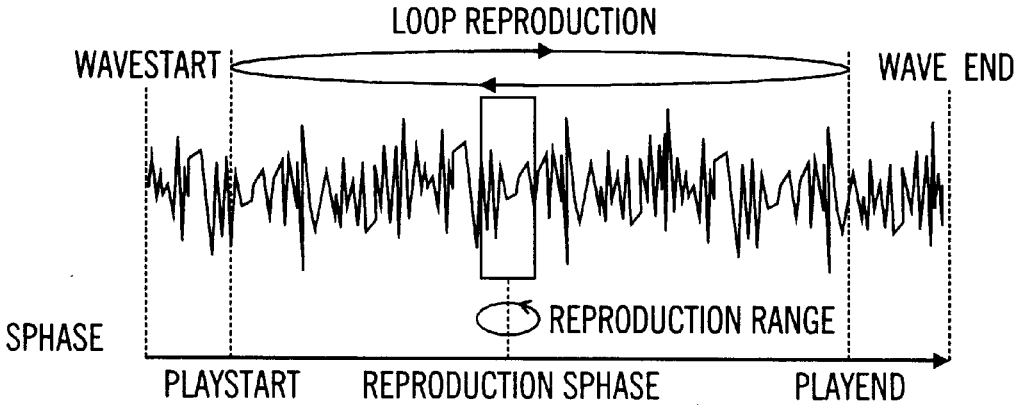
FIG. 4
| BEAT | MARK(i) | △pa(i) |
|---|---|---|
| 0 | MARK(0) = PLAYSTART | [MARK(1)-MARK(0)/360xr |
| 1 | MARK(1) | [MARK(2)-MARK(1)/360xr |
| 2 | MARK(2) | [MARK(3)-MARK(2)/360xr |
| ⋮ | ⋮ | ⋮ |
| n | MARK(n) = PLAYEND | —— |
FIG. 5

METHOD AND APPARATUS FOR WAVEFORM REPRODUCTION

RELATED APPLICATION

The present invention relates to Japanese Patent Application Serial Number 2000-196466, filed Jun. 29, 2000, from which priority is claimed.

BACKGROUND OF THE INVENTION

1. Field of the Invention

The present invention relates to a method and apparatus for waveform reproduction. In preferred embodiments of the invention, it relates to a method and apparatus for reproducing various types of waveform data including, but not limited to, waveform data obtained by sampling a series of performed musical tones and waveform data produced and obtained by other means.

2. Description of Related Art

Waveform reproduction devices have been known for some time in the electronic musical instrument field. For example, there exist devices that sample and store musical tones as waveform data. By reproducing the waveform data, musical tones may be generated. One such device is shown in Japanese Laid-Open Patent Application Publication Number Hei 5-73054, wherein waveform data that has been stored in memory is read out from memory and reproduced in accordance with commands received from a controller.

However, with some waveform reproduction devices of the past, the operation of certain controllers has been directly related to the address locations of the waveform data. Since the corresponding relationship between a specified amount of movement of a controller, for example, one revolution of a control knob, and such musical time parameters as "beats" and "bars" of music being reproduced in response to such movement is often not known, it is typically not possible for a user who operates these controllers to intuitively operate the controller in a way such that movement of the controller corresponds to the musical time parameters.

A waveform reproduction apparatus in which compression and expansion technology on the temporal axis is employed is shown in Japanese Laid-Open Patent Application Publication Number Hei 11-52954. In this apparatus, when the waveform data is reproduced, the reproduced pitch and reproduced tempo are each controlled independently. Since the reproduced tempo at the time that the waveform data is reproduced is specified, it becomes difficult to reproduce the waveform data in a way desired by the user. Accordingly, since the corresponding relationship between the movement of a controller and the increment in the waveform data being reproduced is typically not known, it is typically not possible to intuitively operate the controller in such a way that movement of the controller corresponds to musical time parameters.

SUMMARY

Embodiments of the present invention address the problems associated with technologies of the past. It is therefore an object of an embodiment of the present invention to provide a waveform reproduction method and apparatus that provides a relationship between the amount of movement of a controller and various musical time parameters, including, but not limited to, "beats" and "bars" of music. It is also an object of an embodiment of the present invention to provide a waveform reproduction method and apparatus that allows a user to intuitively move a controller to correspond to such musical time parameters.

In order to achieve the above-mentioned object, an embodiment of the present invention includes a first storage means for storing a series of waveform data and an input means for inputting location information corresponding to movement on a surface. The embodiment also includes a second storage means for storing position information corresponding to delimiters between segments of the waveform data stored in the first storage means, the waveform data having been divided into a multiple number of segments, and for storing corresponding position information indicating a position on the surface, the position on the surface indicated by the surface movement data. Also, the embodiment includes a position information generation means, wherein the position information for the waveform data stored in the first storage means is generated from the corresponding position information stored in the second storage means in accordance with the positions that are indicated by the location information input by the input means. Also, the embodiment includes a waveform formation means for forming musical tones from waveform data stored in the first storage means in accordance with pitches that correspond to pitch information that has been specified and correspond to the position information generated by the position information generation means.

In accordance with embodiments of the present invention, the position information for the waveform data stored in the first storage means is generated by the position information generation means using information corresponding to the position indicated by the surface movement data input by the input means. Since musical tones are formed by the waveform formation means using the waveform data that corresponds to this position information, it is possible for the user, who inputs the location information by the input means, to clearly comprehend the correspondence relationship between the location information that has been input by the input means and the musical time quantities of the waveform data being reproduced. It becomes possible, therefore, to intuitively operate a controller in such a way such that movement of the controller corresponds to musical time parameters.

Further embodiments of the invention include a waveform reproduction apparatus comprising a first memory for storing waveform data and a position detector for detecting position information corresponding to movement on a surface. Embodiments of the invention also include a second memory for storing musical time information; a position generator, wherein the position information for the waveform data stored in the first memory is generated from the corresponding position information stored in the second memory in accordance with the positions detected by the position detector; and a waveform generator for forming musical tones from waveform data stored in the first memory in accordance with pitches that correspond to pitch information that has been specified and corresponding to the position information generated by the position generator. Further, the waveform data of the first memory may comprise sampled music. Also, the position detector may comprise a flat surface, and the flat surface may comprise a pressure sensitive sheet. Further, the musical time information of the second memory may comprise a starting address for each beat of music, and also may comprise an address advance amount corresponding to movement on the surface. The position generator and the waveform generator may be implemented in a digital signal processor. The waveform apparatus may comprise a central processing unit; a digital signal processor interfaced to the central processing unit; a digital-to-analog converter interfaced to the digital signal processor; and a sound system for amplifying and playing music received from the digital-to-analog converter.

Further embodiments of the invention include a method for reproducing a waveform comprising storing waveform data; detecting a position corresponding to movement on a surface; and storing musical time information. The method may also comprise generating a position based on the waveform data and the musical time information; and generating a waveform forming musical tones from the waveform data and the musical time information. The method may also comprise generating a musical signal from the waveform data using a sound system.

BRIEF DESCRIPTION OF THE DRAWINGS

FIG. 3 is a block diagram of an embodiment of the data structure of the waveform memory.

FIG. 4 is a graphical view of a waveform depicting waveform data.

FIG. 5 is a graphical view of an embodiment of the data structure of the musical time information memory.

DETAILED DESCRIPTION OF PREFERRED EMBODIMENTS

Figure 1:
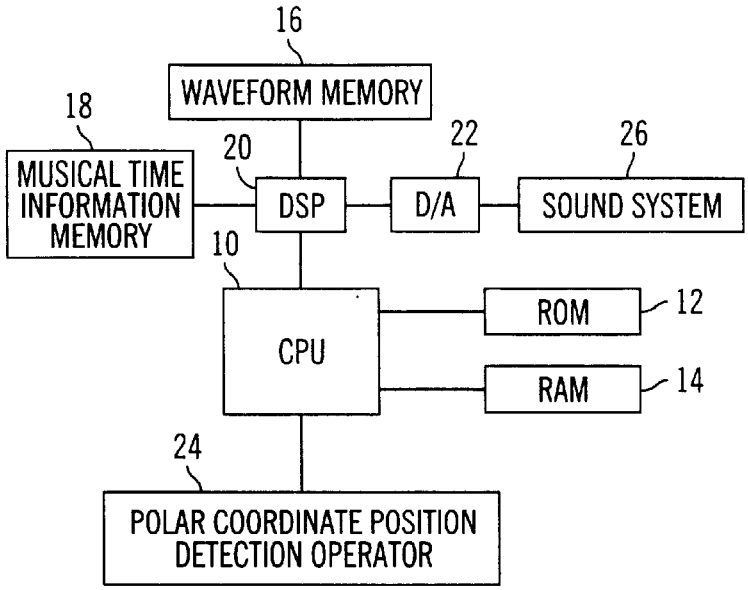
FIG. 1 is a block diagram of a waveform reproduction apparatus in accordance with an embodiment of the present invention.

A structural block diagram of an embodiment of a waveform reproduction apparatus in accordance with an embodiment of the present invention is shown in FIG. 1. The waveform reproduction apparatus of FIG. 1 is configured such that the entire operation is controlled using a central processing unit (CPU) 10. Connected to the CPU 10 are a read only memory (ROM) 12 that contains programs to be executed, a random access memory (RAM) 14 used as a working area in which various buffers and registers required for the execution of programs by the CPU 10 are set, a digital signal processor (DSP) 20 that reads out waveform data stored in waveform memory 16 and directs its output to a digital/analog converter (D/A) 22, and a polar coordinate position detector 24 equipped with a flat surface that may be pressed by the finger of a user.

Connected to the DSP 20 are waveform memory 16, in which various kinds of waveform data are stored, including, but not limited to, waveform data obtained by the sampling of musical tones and waveform data otherwise produced arbitrarily by a user, musical time information memory 18, in which a starting address for each beat of the musical tones that are indicated by the waveform data stored in the waveform memory and an amount by which the address is advanced in relation to the polar coordinate position detector 24 are stored, and the D/A 22 for the conversion of the waveform data, which is output from the DSP 20 as a digital signal, to an analog signal. In addition, a sound system 26 may be connected to the D/A 22. The sound system 26 may be equipped with, for example, amplifiers and speakers in order to generate audio signals from the musical tone signals that are output from the D/A 22.

Figure 2:
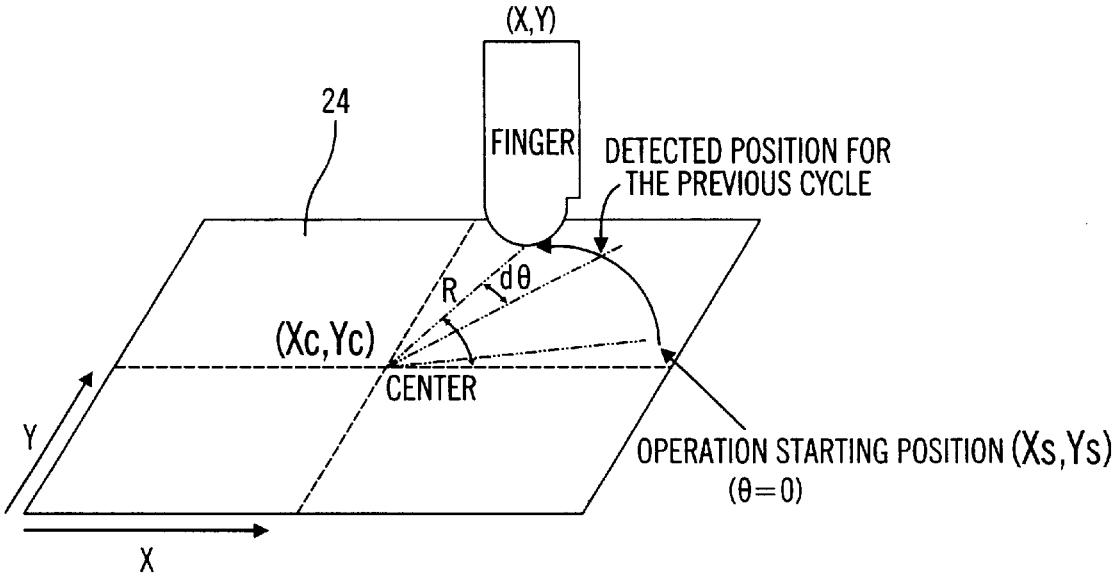
FIG. 2 is a graphical view of an embodiment of polar coordinate position detection.

An embodiment of a polar coordinate position detector 24 is shown in FIG. 2. The polar coordinate position detector 24 may include a flat surface that is pressed by the finger of a user and is used for the detection of position in terms of polar coordinates. The flat surface of the polar coordinate position detector 24 may include a pressure sensitive sheet by which the location on the flat surface that is pressed by the user and the pressure P with which the user presses the flat surface are detected.

When the finger of a user moves along the flat surface of the polar coordinate position detector 24, the location of the finger on the flat surface in terms of polar coordinates is detected for each time period specified by the CPU 10. In operation, the center coordinates (Xc, Yc) may be set as the coordinates of the center of a plane XY. The center coordinates (Xc, Yc) may be set in advance or the user may set them as desired. Next, a determination may be made as to whether or not the polar coordinate position detector 24 is currently being operated based on the pressure P that is output from the polar coordinate position detector 24. Based on that determination, the value of the "gate," which is the flag that indicates whether or not the polar coordinate position detector 24 is being operated, is updated.

For example, in the case where the pressure P that is output from the polar coordinate position detector 24 is a specified value or greater, a determination may be made that the operation of the polar coordinate position detector 24 has begun. Thus, the "gate" may be set to "1" If the pressure P that is output from the polar coordinate position detector 24 is below a specified value, a determination is made that the operation of the polar coordinate position detector 24 has ended and "gate=0" is set.

In the case where the polar coordinate position detector 24 is being operated, the coordinates (X, Y) of the current location, which corresponds to the location of the finger of the user pressing on the flat surface of the polar coordinate position detector 24, is detected by the CPU 10.

Using the current location coordinates (X, Y) detected by the polar coordinate position detector 24 and the center coordinates (Xc, Yc), and assuming the angle for the start position coordinates (Xs, Ys) is 0 degrees, a polar coordinate angle θ may be calculated according to Equation 1, shown below.

$$\theta = a\tan[(Y-Yc)/(X-Xc)] - a\tan[(Ys-Yc)/(Xs-Xc)] \quad (1)$$

With regard to the angle θ calculated using Equation 1, when the polar coordinate position detector 24 is operated, the difference dθ between the angle θ that has been calculated for the current cycle and the angle θ that was calculated for the previous cycle is equivalent to the amount of change in the angle in terms of polar coordinates for the XY plane of the polar coordinate position detector 24. This also indicates the amount of change in the location of the finger of the user on the flat surface of the polar coordinate position detector 24 from its last position to its current position. In this specification, the difference dθ between the angle θ that has been calculated for the current cycle and the angle θ that was calculated for the previous cycle will be referred to as "the operation amount dθ."

In the present embodiment, when the finger of the user moves in a clockwise direction on the flat surface of the polar coordinate position detector 24, the operation amount dθ becomes a negative value. When the finger of the user moves in a counterclockwise direction on the flat surface of the polar coordinate position detector 24, the operation amount dθ becomes a positive value.

Using the coordinates of the current position (X, Y) of the polar coordinate position detector 24 that have been detected and the center coordinates (Xc, Yc), the radius R of the polar coordinates may be calculated using Equation 2, shown below.

$$R=[(X-Xc)^2+(Y-Yc)^2]^{1/2} \quad (2)$$

The data structure of the waveform memory 16 is shown in FIG. 3. Waveform data and data related to the waveform data are stored in the waveform memory 16. The waveform data stored in waveform memory 16 may be in the format of pulse code modulation (PCM) data, obtained by sampling musical tones at a specified time period. A waveform diagram showing the waveform data is shown in FIG. 4.

Additionally, the waveform related data stored in the waveform memory 16 may comprise, as shown in FIG. 3 and FIG. 4, the wavestart address, which is the address of the waveform data that indicates the beginning of the waveform data, the waveend address, which is the address of the waveform data that indicates the end of the waveform data, the playstart address, which is the address of the waveform data that indicates the beginning of the waveform data reproduction segment, and the playend address, which is the address of the waveform data that indicates the end of the waveform data reproduction segment. The playstart address and playend address of the waveform related data may be set by the user. For example, the positions of the playstart address and playend address may be adjusted and set so that if the user reproduces sound by looping the interval from the playstart address to the playend address (see FIG. 4), there is a smooth connection between the music generated from the waveform data at the playend address and the music generated from the waveform data at the playstart address.

FIG. 5 shows the data structure of the musical time information memory 18 according to an embodiment of the present invention. In the musical time information memory 18, mark (i) and Δpa (i) are stored for each beat of the waveform data stored in the waveform memory 16. Mark (i) indicates the starting address of the beat corresponding to the first beat of the waveform data of the reproduced interval from the playstart address to the playend address, while Δpa (i) indicates an amount the address advances in each beat when the polar coordinate position detector 24 detects one degree of finger movement.

The beat count while the finger of the user moves one revolution (360 degrees) on the flat surface of the polar coordinate position detector 24 is the variable r. Then, the amount of address advance Δpa (i) may be derived by $$\Delta pa(i)=[\text{mark}\ (i+1)-\text{mark}(i)]/[360/r]. \quad (3)$$

For example, when one beat's worth of waveform data is reproduced when the finger of the user makes one revolution on the flat surface of the polar coordinate position detector 24, r=1. Likewise, when one beat's worth of waveform data is generated when the finger of the user makes a half revolution (180 degrees) on the flat surface of the polar coordinate position detector 24, r=2.

With regard to the starting address of the beat, mark (i), the 0 beat, mark (0), is the address that indicates the playstart address of the waveform memory 16, and the nth beat, mark (n), is the address that indicates the playend address of the waveform memory 16. In other words, the musical time information memory 18 stores the starting address mark (i) for the total number of beats n of the waveform data in the reproduced segment from the playstart address to the playend address, as well as the amount of address advance Δpa (i) in each beat, which is equivalent to one degree of movement of the polar coordinate position detector 24.

The starting address for each beat, mark (i), may be set, for example, as follows. First, the number of addresses for the waveform data in the reproduced segment from the playstart address to the playend address is divided by the entire number of beats n in the reproduced segment. The resulting number may be added to the first starting address of the beat to determine each starting address of each beat, mark (i).

To determine the entire number of beats n in the reproduced segment, the number of bars specified by the user may be multiplied by the number of beats per bar. Alternatively, the time of the reproduced segment may be divided by the tempo specified by the user to determine the number of beats in the reproduced segment.

Next, each of the starting addresses mark (i) of the beats that have been set may be automatically shifted to a waveform data attack position that is located in the vicinity of the starting address mark (i) of the beat. The address of this shifted attack position may be made the starting address mark (i) of the beat. Alternatively, the waveform data attack position may be automatically set by locating the address at which the volume of the reproduced music suddenly becomes greater, i.e., by detecting the area where the waveform data starts up.

Lastly, the starting address mark (i) of the beat that has been set by step 1 or step 2 above may again be adjusted at the discretion of the user and made the starting address mark (i). The starting address mark (i) is ultimately set at the discretion of the user.

Figure 6:
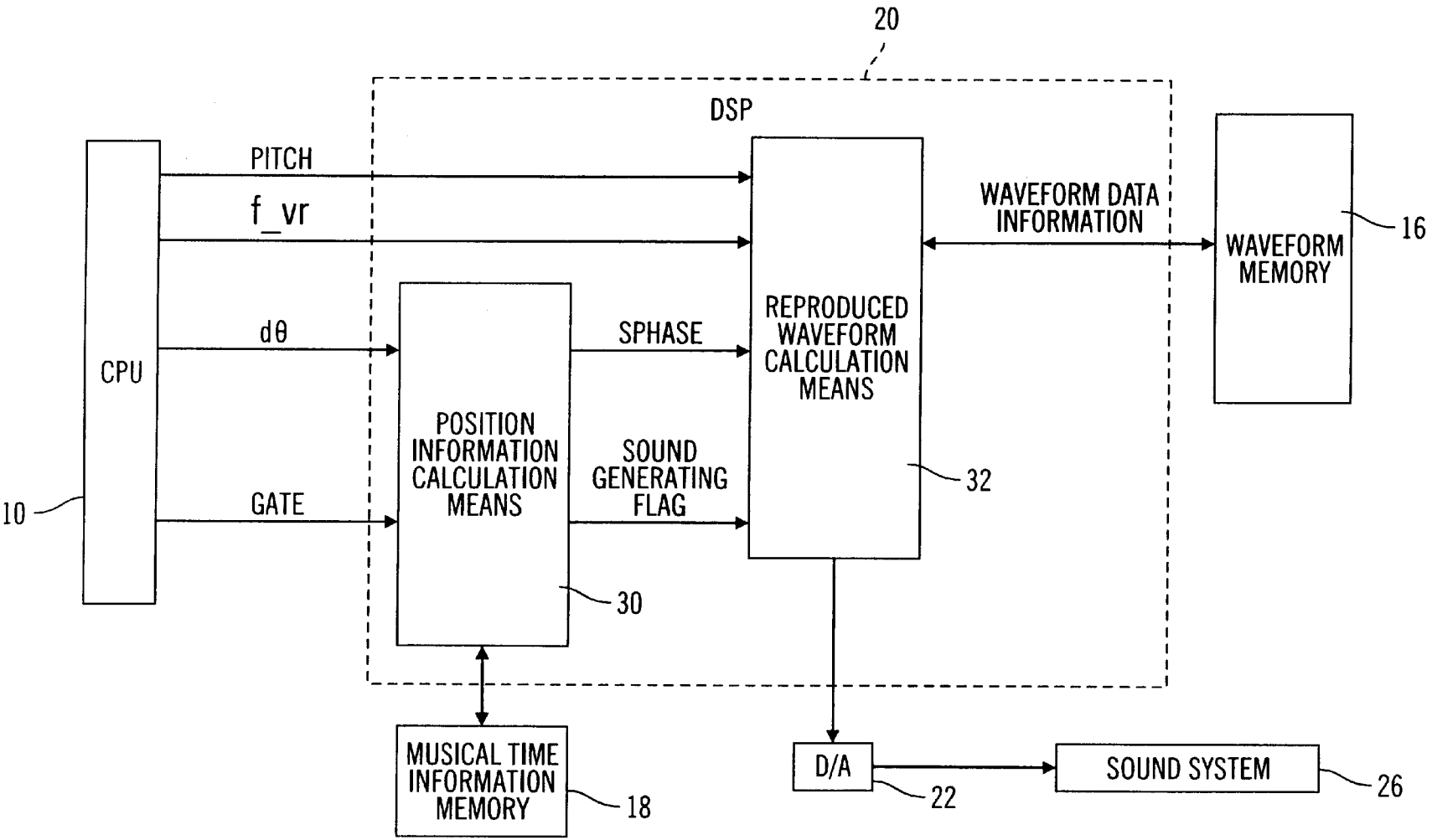
FIG. 6 is a block diagram of an embodiment of the overall operation of the waveform reproduction apparatus in accordance with an embodiment of the present invention.

The overall operation of the waveform reproduction apparatus in accordance with an embodiment of the present invention may be described in reference to FIG. 6. In this embodiment of the waveform reproduction apparatus, the pitch, the formant (f_vr), the operation amount dθ of the polar coordinate position detector 24, and the gate, which indicates whether or not the polar coordinate position detector 24 is in operation, are sent to the DSP 20 from the CPU 10. The respective values of the pitch and the formant (f_vr) may be set by the radius R that is calculated from the position of the finger on the flat surface of the polar coordinate position detector 24 and the pressure P exerted by the finger on the flat surface of the polar coordinate position detector 24. Alternatively, the pitch and formant (f_vr) may be set by a separate detector that is not shown in the drawing.

Also, the musical time information memory 18 may be accessed for the operation amount dθ as well as the gate that has been sent from the CPU and determined by the position information calculation means 30. This information is sent to and utilized by the DSP 20. In addition, the sphase, which relates to position information, and the sound generating flag, which indicates whether sound generation information is available, are sent to the reproduced waveform calculation means 32 that is implemented by the DSP 20.

An explanation will be given here regarding the sphase, which relates to the position information that is sent from the position information calculation means 30 to the reproduced waveform calculation means 32. First, when the pressure P exerted by the flat surface of the polar coordinate position detector 24 by a finger of a user becomes a specified value or greater, the sphase is set to the playstart address. When the finger moves on the flat surface of the polar coordinate position detector 24, the sphase changes in conformance with the angle and the direction of movement at that time. For example, if the finger moves in a counterclockwise direction, the sphase increases in conformance with the angle. Conversely, if the finger moves in a clockwise, the sphase decreases in conformance with the angle. The waveform data is generated in accordance with the sphase when the sphase is input to the reproduced waveform calculation means 32.

Various methods may be employed by which the specified pitch and length of the musical tones that are reproduced may be changed independently. For example, in accordance with the method that is in Japanese Laid-Open Patent Application Publication Number Hei 11-52954, it is possible to change the address at the read out speed in conformance with the pitch of one cycle or several cycles of waveform data that include the virtual address indicated by the sphase (the waveform data of the reproduction range shown in FIG. 4).

Figure 7:
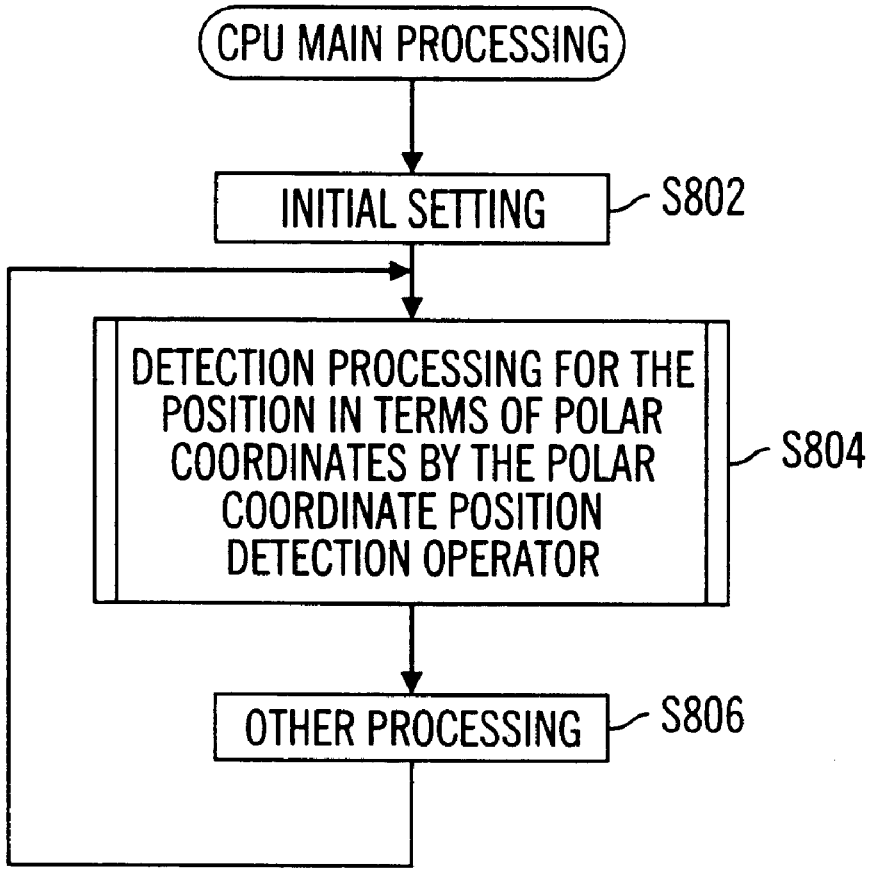
FIG. 7 is a flowchart that shows the main routine of the CPU according to an embodiment of the invention.

Details of the above mentioned waveform reproduction processing are shown in the flowcharts of FIG. 7 through FIG. 10. When the power to the waveform reproduction apparatus in accordance with an embodiment of the present invention is turned on, the main routine of the CPU 10 that is shown in FIG. 7 is executed. In Step S802, initializing steps, such as clearing each register, for example, are carried out.

When Step S802 has been completed, processing proceeds to Step S804. In this step, detection of the position in terms of polar coordinates is carried out by the polar coordinate position detector 24 as a sub-routine of the main routine of the CPU 10. Details with regard to detection of the position in terms of polar coordinates will be discussed below while referring to the flow chart shown in FIG. 8. When Step S804 has been completed, processing proceeds to Step S806.

In Step S806, registers and buffers may be set in accordance with the characteristics of operators not shown in the drawing or other processing, such as, for example, the lighting and extinguishing of displays. Once Step S806 has been completed, processing returns to Step S804, and Steps S804 and S806 may be repeated as necessary.

Figure 8:
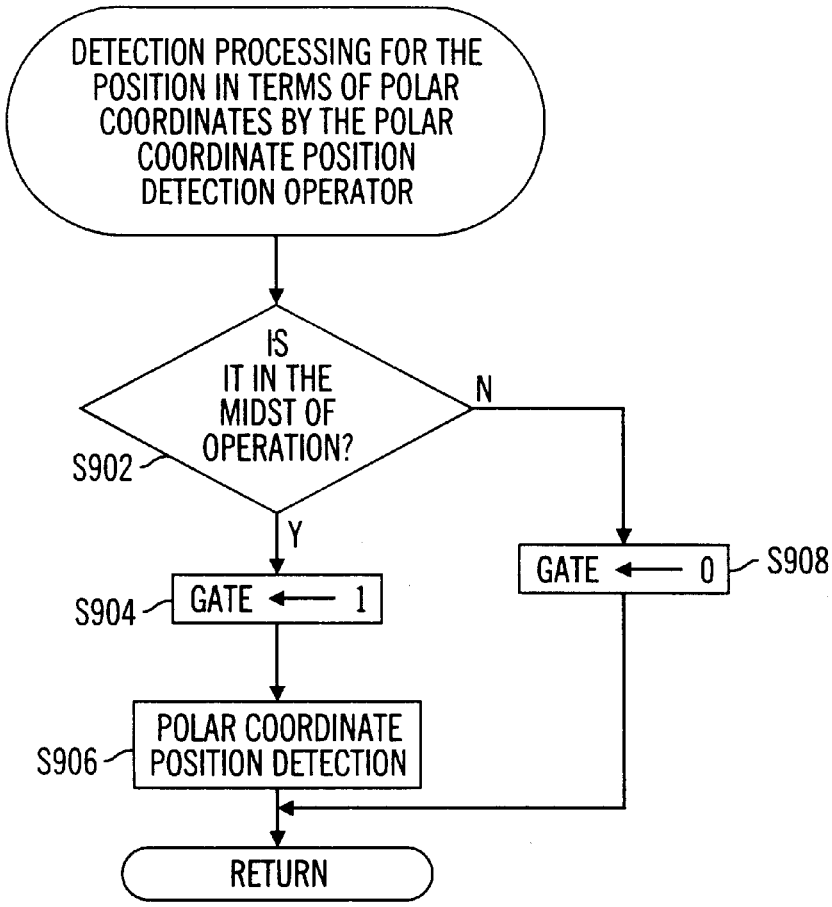
FIG. 8 is a flowchart that shows the detection processing routine for the position in terms of polar coordinates by the polar coordinate position detector according to an embodiment of the invention.

The flowchart of the process of the detection, Step S804 of FIG. 7, is shown in FIG. 8. At Step S902, a determination is made as to whether or not the pressure P that is output from the polar coordinate position detector 24 is greater than a specified value. In the case where it is smaller than the specified value, it may be determined that there is no operation by a finger or the like on the flat surface of the polar coordinate position detector 24. Then, at Step S908, the value of the register gate is set to "0." Following step S908, processing is transferred back to the main routine of CPU 10.

On the other hand, if the pressure P is greater than the specified value, a determination is made that a finger or the like is operating the polar coordinate position detector 24, and the value of the register gate is set to "1" in Step S904. The polar coordinates, the angle dθ and the radius R are derived in accordance with the previously discussed Equation 1 and Equation 2 in Step S906. In the case where there is a change in the value of the angle dθ, the difference from the value that was detected in the previous cycle, the operation amount dθ, is calculated and sent to the DSP 20. Following step S906, processing is transferred back to the main routine of CPU 10.

Figure 9:
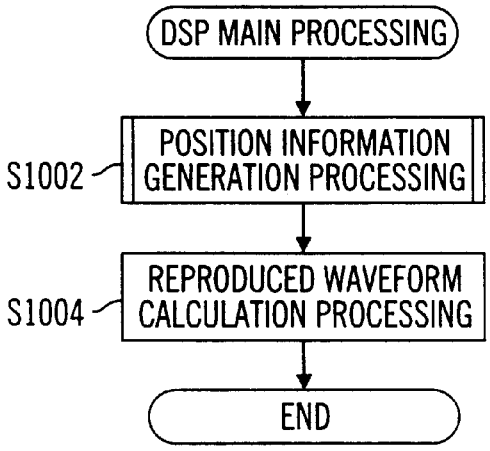
FIG. 9 is a flowchart of the main routine of the DSP according to an embodiment of the invention.

Details of the main routine executed in the DSP 20 at each specified time interval are shown in FIG. 9. When the main routine of the DSP 20 is started, first, in Step S1002, the position data generation routine is executed as a sub-routine of the main routine of the DSP 20. When the processing of Step 1002 has been completed, processing proceeds to Step S 1004. Position data generation processing will be discussed below in reference to FIG. 10.

The reproduced waveform calculation processing is carried out in Step S1004. Waveform data is read out from the waveform memory 16 by the reproduced waveform calculation means 32 and output to the D/A 22 based on the sphase that is sent from the position information calculation means 30, the sound generating flag, and the pitch sent from the CPU 10.

Figure 10:
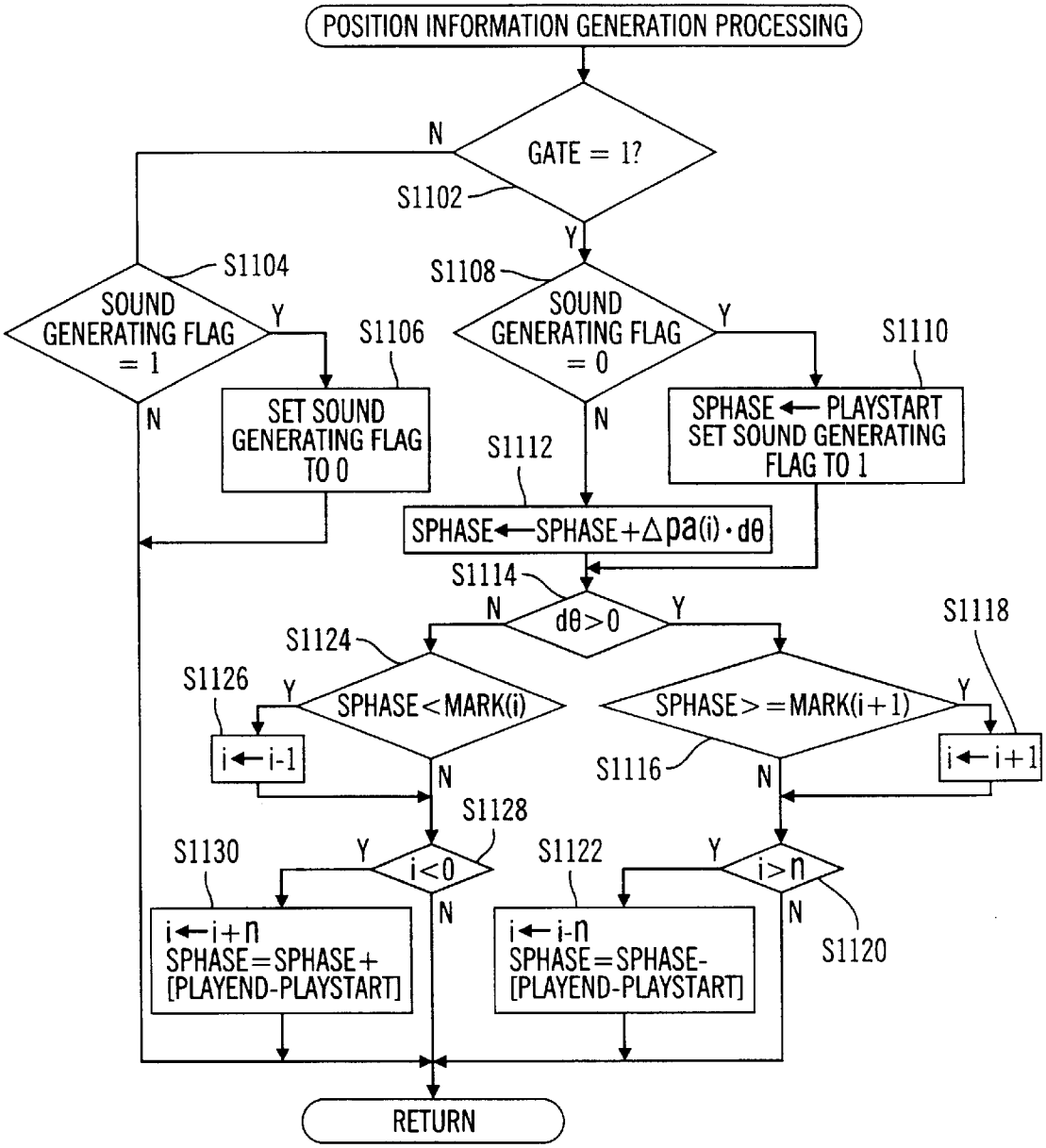
FIG. 10 is a flowchart that shows a position data generation routine according to an embodiment of the invention.

Details of the position data generation processing in Step S1002 are shown in FIG. 10. In the position data generation processing, the processing for the position data is carried out. The sphase, sent by the position information calculation means 30 to the reproduced waveform calculation means 32, and the sound generating flag are determined from the operation amount dθ and the gate that is sent from the CPU 10. First, a determination is made as to whether or not the gate has been set to "1" in Step S1102. In the case where the gate has been set to "1" or, in other words, that the polar coordinate position detector 24 is being operated, processing proceeds to Step S1108.

In the case where a determination has been made at Step S1108 that the sound generating flag has been set to "0" or, in other words, where the waveform reproduction apparatus is in the midst of sound damping, processing proceeds to Step S1110. At Step S1110, the sphase is set to the playstart address and the value of the processing variable i, which indicates which beat the waveform data is at, is initialized to "0." In addition, the sound generating flag is set to "1" in Step S1110. In other words, the sound generating flag is changed to "1" from "0" and the sound generation processing begins. When the processing of Step S1110 is completed, processing proceeds to Step S1114.

Accordingly, when the polar coordinate position detector 24 is being operated and, moreover, when the waveform reproduction apparatus is in the midst of sound damping, processing proceeds from Step S1102 to Step S1108 and then to Step S1110, thereby shifting to a sound generating state.

On the other hand, if it has been determined that the gate has not been set to "1" or, in other words, that the gate has been set to "0" and the polar coordinate position detector 24 is not being operated, processing proceeds to Step S1104. At Step S 1104, a determination is made as to whether or not the sound generating flag has been set to "1." If sound generating flag has been set to "1" or, in other words, if the waveform reproduction apparatus is in the midst of generating sound, processing proceeds to Step S1106. On the other hand, where the sound generating flag has not been set to "1" or, in other words, where the waveform reproduction apparatus is not in the midst of generating sound, the position data generation processing terminates and control returns to the main routine of the DSP 20.

Next, at Step S1106, the sound generating flag is set to "0." In other words, the sound generating flag is changed to "0" from "1" and the sound damping processing begins. When Step S1106 is completed, the position data generation processing terminates and control returns to the main routine of the DSP 20.

Accordingly, in the case where the polar coordinate position detector 24 is not being operated and the waveform reproduction apparatus is in the midst of generating sound, processing proceeds from Step S1102 to Step S1104 and then to Step S1106, shifting to a sound damping state.

However, if the sound generating flag has not been set to "0" or, in other words, if the waveform reproduction apparatus is not in the midst of sound damping, processing proceeds to Step S1112. In Step S1112, the sphase is set to the sum of the sphase plus the product of the address advance amount Δpa (i) and the operation amount dθ. Because of this, the advance position, which indicates the sphase in the waveform data, advances an amount that corresponds to the operation amount dθ of the polar coordinate position detector 24, and the reproduction address for this cycle is set to the new value of sphase.

Following Step S1112, processing proceeds to Step S1114. In this step, a determination is made as to whether or not the value of the operation amount dθ is greater than 0. If the operation amount dθ is greater than 0, it may be determined that a finger moving on the flat surface of the polar coordinate position detector 24 is moving in a counterclockwise direction, and processing subsequently proceeds to Step S1116. If the operation amount dθ is smaller than 0, it may be determined that a finger on the flat surface of the polar coordinate position detector 24 is moving in a clockwise direction, and processing subsequently proceeds to Step S1124.

In the case where the value of the operation amount dθ is greater than 0, since, in the processing of Step S 1116, a finger is moving in a counterclockwise direction on the flat surface of the polar coordinate position detector 24, a determination is made as to whether or not the sphase coincides with the mark (i+1) or exceeds it and, if the sphase coincides with the mark (i+1) or exceeds it, processing proceeds to Step S1118. At Step S1118, the value of the processing variable i is incremented by "1" and processing proceeds to Step S 1120.

On the other hand, if the sphase does not exceed the address of the mark (i+1), processing proceeds directly to Step S1120. In Step S1120, a determination is made as to whether or not the processing variable is equal to or greater than the overall beat count n for the waveform data in the reproduction segment from the playstart address to the playend. In the case where the processing variable i is equal to or greater than the overall beat count n, since the $i^{th}$ beat coincides with or exceeds the playend address, processing proceeds to Step S1122. If it is determined in Step S1120 that the processing variable i is not equal to or greater than the overall beat count n, since the $i^{th}$ beat does not exceed the playend address, the position data generation processing terminates and returns to the main routine of the DSP 20.

In Step S1122, the processing variable i is set to "i−n." Also, the sphase is set to the difference between the playstart address and the playend address subtracted from the sphase, thereby changing the reproduction address and the beat in conformance with loop reproduction. When Step S1122 has been completed, the position data generation processing terminates and control returns to the main routine of the DSP 20.

Returning to Step S1114, if the operation amount dθ is less than 0, processing proceeds to Step S1124. In Step S1124, a finger is moving in a clockwise direction on the flat surface of the polar coordinate position detector 24. In this step, a determination is made as to whether or not the sphase is less than the mark (i). In the case where the sphase is less than the mark (i), processing proceeds to Step S1126. The value of the processing variable "i" is decremented by "1" in Step S1126. Processing then proceeds to Step S1128. However, if the sphase is not less than the mark (i), the sphase has reached the mark (i) and processing proceeds directly to Step S1128.

In Step S1128, a determination is made as to whether or not the processing variable is less than the 0 beat for the waveform data in the reproduction segment from the playstart address to the playend address. In the case where the processing variable "i" is less than the 0 beat, the $i^{th}$ beat exceeds the playstart address and processing proceeds to Step S1130. On the other hand, in the case where the processing variable "i" is the 0 beat or greater, since the $i^{th}$ beat does not exceed the playstart address, the position information generation processing routine terminates and returns to the main routine of the DSP 20.

In Step S1130, the processing variable i is set to "i+n." Also, the sphase is set to the difference between the playstart address and the playend address added to the sphase, thereby changing the reproduction address and the beat in conformance with loop reproduction. When Step S1130 has been completed, the position data generation processing terminates and control returns to the main routine of the DSP 20.

As has been described above, according to an embodiment of the present invention, when the finger of a user moves one revolution (360 degrees) on the flat surface of the polar coordinate position detector 24, the operation amount dθ corresponds to one beat of the waveform data stored in the waveform memory 16. The reproduction address may be calculated in conformance with the operation amount dθ of the polar coordinate position detector 24 utilizing the position data generation processing routine. Thus, it becomes possible for a user who operates the polar coordinate position detector 24 to clearly comprehend the relationship between the operation amount dθ of the polar coordinate position detector 24 and the bar and beat values of the waveform data being reproduced, and to intuitively carry out the operation of the polar coordinate position detector 24.

In the above mentioned preferred embodiment, one revolution (360 degrees) on the flat surface of the polar coordinate position detector 24 corresponds to one beat of the waveform data. However, other embodiments, of course, are not limited to this and the waveform reproduction apparatus may be set up so that one revolution (360 degrees) on the flat surface of the polar coordinate position detector 24 corresponds to two or more beats or a bar of the waveform data. The correspondence between the operation amount dθ of the polar coordinate position detector 24 and a specified amount of a musical time quantity such as the beats or the bars of the waveform data may be set as desired.

Also, in the above mentioned preferred embodiment, the starting address mark (i) of each beat of the waveform data of the reproduced segment from the playstart address to the playend address and the address advance amount Δpa (i) in each beat are stored in the musical time information memory 18. Furthermore, the starting address mark (i) is the address that corresponds to the beginning of the beat. However, other embodiments, of course, are not limited to this and the waveform reproduction apparatus may be set up so that the starting address of the beat, mark (i), is an address that does not correspond to the beginning of the beat. This address may be set arbitrarily. Furthermore, the address advance amount Δpa (i) may be set to an amount not equal to one beat.

Also, in the above mentioned preferred embodiment, the starting address of the beat mark (i) and the address advance amount Δpa (i) are stored in the musical time information memory 18. However, other embodiments, of course, are not limited to this and the waveform reproduction apparatus may be set up so that the starting address of the beat, mark (i), and the address advance amount Δpa (i) are calculated. For example, using the overall beat count n of the waveform data in the reproduced segment from the playstart address to the playend address, it is possible to calculate the starting address of the beat, mark (i), and the address advance amount Δpa (i) as follows:

$$mark(i)=playstart+(playend-playstart)/n\times(i)$$

$$\Delta pa(i)=(playend-playstart)/(n\times 360).$$

Also, in the above mentioned preferred embodiment, in the position data generation processing routine, the pressure P on the polar coordinate position detector 24 is detected at the position (X, Y) and the radius R is calculated in terms of polar coordinates. However, other embodiments may be set up so that the calculated pressure P and radius R are assigned to the pitch and the volume or the formant of the musical tones and respectively controlled by the amount of pressure applied by the user and the radius R designated by the user.

Also. in the above mentioned preferred embodiment, in the reproduced segment from the playstart address to the playend address, when the reproduction address of the waveform exceeds the playend address, the reproduced segment is reproduced from the playstart address and the reproduced segment is looped. However, other embodiments, of course, are not limited to this and the waveform reproduction apparatus may be set up so that reproduced segments are not looped.

As has been explained above, embodiments of the present invention allow one to intuitively carry out the operation of associating the amount of operation of various operators with such musical time quantities as "beats" and "bars" of music. While the invention has been described with reference to its preferred embodiments, those skilled in the art will understand and appreciate from the foregoing that variations in equipment, operating conditions and configuration may be made and still fall within the spirit and scope of the present invention which is to be limited only by the claims appended hereto.

What is claimed is:

1. A waveform reproduction apparatus comprising a first storage means for storing a series of waveform data;

an input means for inputting location information corresponding to movement on a surface;

a second storage means for storing position information corresponding to delimiters between segments of the waveform data stored in the first storage means, the waveform data having been divided into a multiple number of segments, and for storing corresponding position information indicating a position along the surface, the position along the surface indicated by the surface movement data;

a position information generation means, wherein the position information for the waveform data stored in the first storage means is generated from the corresponding position information stored in the second storage means in accordance with the positions that are indicated by the location information input by the input means; and waveform formation means for forming musical tones from waveform data stored in the first storage means in accordance with pitches that correspond to pitch information that has been specified and corresponding to the position information generated by the position information generation means.

2. A waveform reproduction apparatus comprising:

a first memory for storing waveform data;

a position detector for detecting position information corresponding to movement on a surface;

a second memory for storing musical time information;

a position generator, wherein the position information for the waveform data stored in the first memory is generated from information stored in the second memory in accordance with the positions detected by the position detector; and a waveform generator for forming musical tones from waveform data stored in the first memory in accordance with pitches that correspond to pitch information that has been specified and corresponding to the position information generated by the position generator.

3. The apparatus of claim 2, wherein the waveform data of the first memory comprises sampled music.

4. The apparatus of claim 2, wherein the position detector comprises a flat surface.

5. The apparatus of claim 2, wherein the musical time information of the second memory comprises a starting address for each beat of music.

6. The apparatus of claim 2, wherein the musical time information of the second memory further comprises an address advance amount corresponding to movement on the surface.

7. The apparatus of claim 6, wherein the musical time information of the second memory further comprises an address advance amount corresponding to movement on the surface.

8. The apparatus of claim 2, wherein the position generator and the waveform generator are implemented in a digital signal processor.

9. The apparatus of claim 2, further comprising a central processing unit;

a digital signal processor interfaced to the central processing unit;

a digital-to-analog converter interfaced to the digital signal processor;

a sound system for amplifying and playing music received from the digital-to-analog converter.

* * * * *

UNITED STATES PATENT AND TRADEMARK OFFICE

CERTIFICATE OF CORRECTION

PATENT NO. : 6,646,194 B2
DATED : November 11, 2003
INVENTOR(S) : Tadao Kikumoto It is certified that error appears in the above-identified patent and that said Letters Patent is hereby corrected as shown below:

Column 4,
Line 55, should read -- $\theta = \text{atan}[(Y - Yc) / (X - Xc)] - \text{atan}[(Ys - Yc) / (Xs - Xc)]$ (1) --.

Signed and Sealed this

Twenty-seventh Day of December, 2005

JON W. DUDAS
*Director of the United States Patent and Trademark Office*